US008820530B1

(12) United States Patent
Blagg

(10) Patent No.: US 8,820,530 B1
(45) Date of Patent: Sep. 2, 2014

(54) AIRPORT BAGGAGE TUB

(76) Inventor: Marcus Blagg, Dallas, TX (US)

( * ) Notice: Subject to any disclaimer, the term of this patent is extended or adjusted under 35 U.S.C. 154(b) by 132 days.

(21) Appl. No.: 13/523,071

(22) Filed: Jun. 14, 2012

(51) Int. Cl.
*B65D 1/34* (2006.01)
*B65D 21/00* (2006.01)
*B65D 21/02* (2006.01)

(52) U.S. Cl.
CPC ..... *B65D 1/34* (2013.01); *B65D 21/0233* (2013.01)
USPC ..... 206/557; 206/505

(58) Field of Classification Search
CPC ..... B65D 1/34; B65D 21/0233
USPC ..... 206/557–567, 505
See application file for complete search history.

(56) References Cited

U.S. PATENT DOCUMENTS

| | | | | |
|---|---|---|---|---|
| 2,777,626 | A * | 1/1957 | French | 229/406 |
| 8,056,725 | B2 * | 11/2011 | Doster | 206/564 |
| 2005/0173284 | A1 * | 8/2005 | Ambrefe, Jr. | 206/459.5 |
| 2006/0032780 | A1 * | 2/2006 | Heyn | 206/557 |
| 2006/0243632 | A1 * | 11/2006 | Trahan | 206/557 |
| 2009/0101655 | A1 * | 4/2009 | Tess et al. | 220/560 |
| 2011/0139660 | A1 * | 6/2011 | Cabell et al. | 206/459.5 |
| 2011/0189355 | A1 * | 8/2011 | Field et al. | 426/129 |
| 2011/0315595 | A1 * | 12/2011 | Gassick et al. | 206/557 |
| 2013/0098800 | A1 * | 4/2013 | Rehmanji et al. | 206/557 |

* cited by examiner

*Primary Examiner* — Luan K Bui
(74) *Attorney, Agent, or Firm* — Plager Schack LLP

(57) ABSTRACT

An airport baggage tub, comprises a molded sheet. The molded sheet further comprises a large radius corner and a slick surface edge. The molded sheet is mechanically coupled to a material region.

3 Claims, 1 Drawing Sheet

AIRPORT BAGGAGE TUB

FIELD OF THE INVENTION

This invention relates to devices that enable goods to efficiently move on conveyor systems.

BACKGROUND OF THE INVENTION

Presently, airports must screen checked luggage for explosives by running the checked luggage through an Explosive Detection System (EDS). The EDS is a belt conveyor apparatus that pulls a container through a system that screens for explosives. The front of the EDS is covered by a lead curtain to avoid exposing the technician to excessive x-rays and other radiation.

However, the lead curtain is very heavy and traditional small radius corner baggage tubs currently used in airport conveyer systems frequently fail to make it through the curtain without jamming, and thus fail to make it through the EDS. Lighter luggage can be pulled from the traditional small radius corner baggage tub into the EDS which causes jamming, alarms and necessitates manual luggage screening.

The present invention teaches an airport baggage tub, which solves all of these problems.

BRIEF SUMMARY OF THE INVENTION

An airport baggage tub, comprises a molded sheet. The molded sheet further comprises a large radius corner and a slick surface edge. The molded sheet is mechanically coupled to a material region.

BRIEF DESCRIPTION OF THE SEVERAL VIEWS OF THE DRAWINGS

Figure 1:
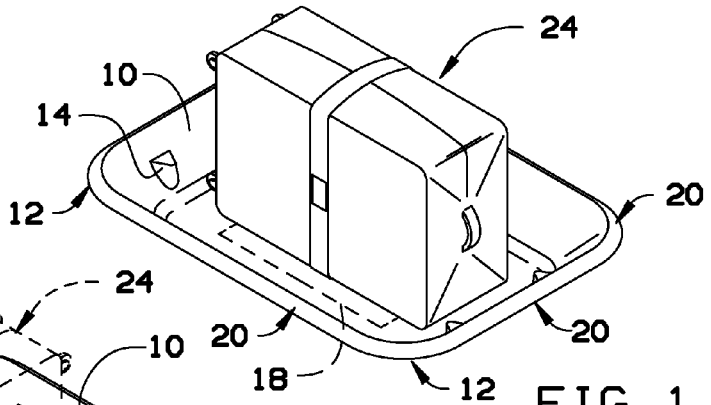

Having thus described the invention in general terms, reference will now be made to the accompanying drawings, which are not necessarily drawn to scale, and wherein:

FIG. 1 is an upper perspective view of the invention shown in use.

Figure 2:
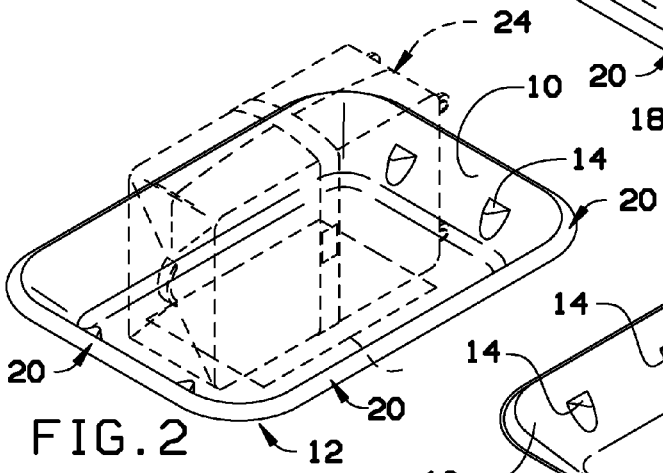

FIG. 2 is an upper perspective view of the invention shown in use.

Figure 3:
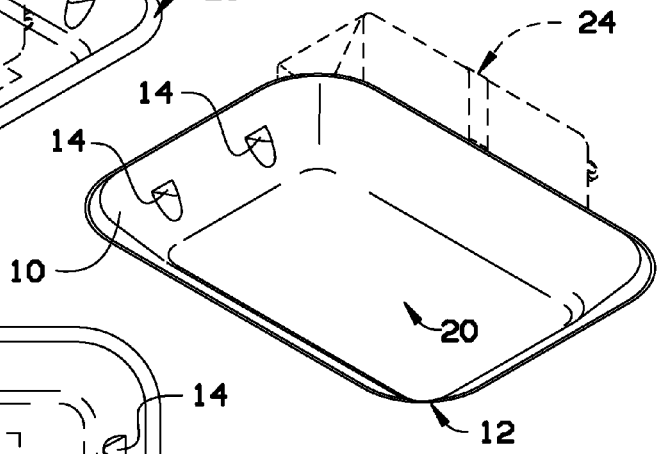

FIG. 3 is a lower perspective view of the invention shown in use.

Figure 4:
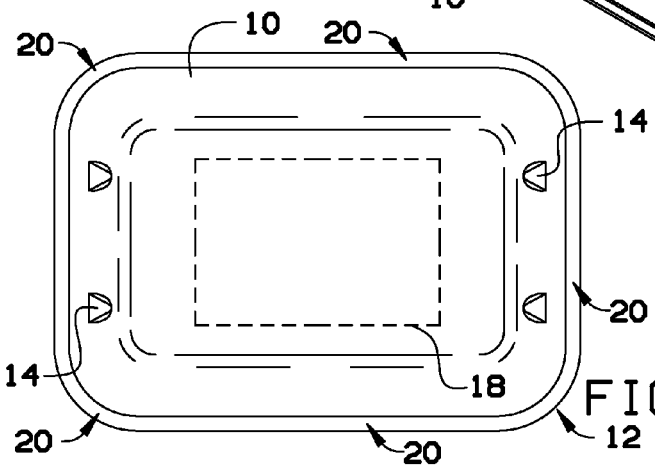

FIG. 4 is a top view of the invention.

Figure 5:
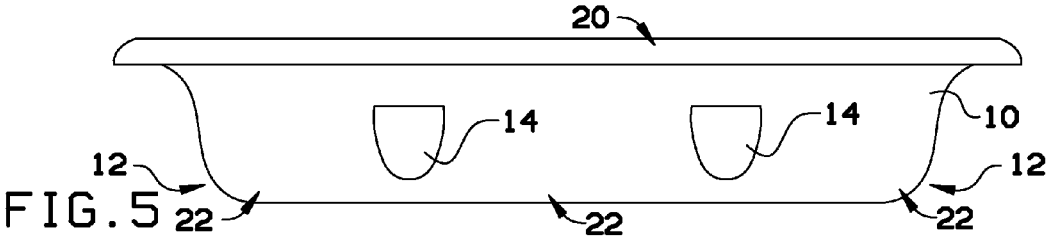

FIG. 5 is a side view of the invention.

DETAILED DESCRIPTION OF THE INVENTION

Embodiments of the present invention overcome many of the obstacles associated with traditional small radius airport baggage tubs, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. A user desires to move baggage 24 with airport baggage tub 10. The user places baggage 24 onto material region 18. Airport baggage tub 10 comprises large radius corner 12, slick surface edge 20, and negative draft indentation 14.

FIG. 2 shows another view of airport baggage tub 10. While, the device can be made from a large number of materials including plastic, metal and wood, metal can cause difficulties with the EDS and is not recommended. To build the device from plastic, a manufacturer should utilize a plastic vacuuming forming machine utilizing aluminum tooling with water lines to control mold temperature. A plastic sheet can be cut to size and inserted into a clamping frame to hold a sheet while it is heated to the appropriate temperature and sag for forming. The plastic sheet is then placed above or below the tooling on a platform, which is pushed into the heated plastic by a mold while applying vacuum creating a molded sheet. The molded sheet is then cooled on the mold by air until it is ready for removal from the platform. The tub is then base routed and drain holes can be drilled as requested.

FIG. 3 and FIG. 5 show negative draft indention 14 from a bottom view and top view of airport baggage tub 10. One of the difficulties with airport baggage tubs prior to the disclosed invention is that compressing the airport baggage tubs together resulted in the airport baggage tubs sticking together and requiring substantial manual effort to separate airport baggage tubs. The present invention solves that problem with the insertion of negative draft indentions. Negative draft indentions creates a pocket of air which prohibits an otherwise strong vacuum force from holding a first airport baggage tub 10 to a second airport baggage tub 10. As shown, here with baggage 24, airport baggage tub 10 is not overloaded which could cause further difficulties in EDS. The underside of airport baggage tub 10 is mechanically coupled to second material surface 22. Second material surface 22 can be identical to material surface 18 in composition and method for application to airport baggage tub 10. The primary difference is function, while material surface 18 serves to keep baggage in place and from being moved by lead curtains, second material surface 22 serves to increase the friction between baggage tub 10 and belt conveyer of EDS.

FIG. 4 shows slick surface edge 20 of airport baggage tub 10 in more detail. Slick surface edge 20 provides a unique curled edge geometry that enables baggage 24 to quickly pass through EDS. Similarly, large radius corner 12 on slick surface edge 20 prevent airport baggage tub 10 from becoming stuck in EDS. Note that airport baggage tub 10 has an inward angled side, that is the perimeter of slick surface edge 20 is greater than the perimeter of material surface 18.

Regarding materials, High Molecular Weight Polyethylene (HMWPE) is ideal for airport baggage tub 10. Material region 18 and second material region 22 should be Lavant texture non-skid non-abrasive material. Material region 18 and second material region 22 can be applied with a male tool to prevent crushing a texture of material region 18.

That which is claimed:

1. An airport baggage tub, comprising, a molded sheet having four side walls connected to one another with large radius corners and surrounded by a slick surface edge;

wherein the side walls descend to a bottom wall;

wherein the slick surfaced edge is angled inward from top to bottom so as not to become stuck in an Explosive Detection System;

wherein the slick surface edge encircles the bottom wall;

wherein each side wall has a middle centrally located on the side wall away from the large radius corners, the slick surface edge and the bottom wall;

a non-skid non-abrasive material region directly attached to the bottom wall; and at least two negative draft indentions centrally located on two opposite side walls offset from the slick surface edge and the bottom wall; wherein each negative drafting indention comprises a flap cut out from the side wall extending inward from the side wall; wherein centrally locating the negative draft indentions permits a pocket of air to form in the negative draft indention that enables separating the airport baggage tub from another.

2. The airport baggage tub of claim 1, further comprising, wherein an outer surface of the bottom wall is directly attached to a second non-skid non-abrasive material region.

3. The airport baggage tub of claim 1, further comprising, where the molded sheet is made from High Molecular Weight Polyethylene.

* * * * *